US007740164B2

(12) United States Patent
McClure

(10) Patent No.: US 7,740,164 B2
(45) Date of Patent: Jun. 22, 2010

(54) INSIDE-TAPER CORNER POST TRAY AND THE ASSOCIATED CONTAINER BLANK

(75) Inventor: Jack A. McClure, Omaha, NE (US)

(73) Assignee: International Paper Company, Memphis, TN (US)

( * ) Notice: Subject to any disclaimer, the term of this patent is extended or adjusted under 35 U.S.C. 154(b) by 553 days.

(21) Appl. No.: 11/428,142

(22) Filed: Jun. 30, 2006

(65) Prior Publication Data

US 2008/0000784 A1 Jan. 3, 2008

(51) Int. Cl.
*B65D 5/28* (2006.01)

(52) U.S. Cl. ..... 229/190; 229/915; 229/918; 229/177

(58) Field of Classification Search ..... 206/158, 206/586, 453; 229/177, 143, 191, 918, 919, 229/108, 103, 190, 915
See application file for complete search history.

(56) References Cited

U.S. PATENT DOCUMENTS 1,218,353 A * 3/1917 Bachmann ..... 229/165
2,605,953 A * 8/1952 Williamson ..... 229/168
2,646,915 A * 7/1953 Bockmann ..... 229/113
2,838,222 A * 6/1958 Papadopoulos ..... 229/117.14
3,412,924 A * 11/1968 Krzyzanowski ..... 229/120.011
3,883,067 A * 5/1975 McGlynn et al. ..... 229/177
4,236,740 A * 12/1980 Sorenson et al. ..... 229/143
5,487,505 A * 1/1996 Nilsson ..... 229/191
5,501,395 A * 3/1996 McElroy ..... 229/148
5,860,590 A * 1/1999 Blomfield et al. ..... 229/165
5,913,474 A * 6/1999 Chu ..... 229/167
5,996,885 A * 12/1999 Chu ..... 229/179
6,508,395 B2 * 1/2003 McLeod ..... 229/174
6,568,588 B2 * 5/2003 Holdsworth et al. ..... 229/164
6,651,875 B2 * 11/2003 Chu ..... 229/191
7,207,473 B2 * 4/2007 Fry ..... 229/174
7,487,905 B2 * 2/2009 McClure ..... 229/143
2005/0040217 A1 * 2/2005 Fry ..... 229/164
2005/0236466 A1 * 10/2005 McLeod ..... 229/143
2006/0091194 A1 * 5/2006 Fry ..... 229/174
2006/0138204 A1 * 6/2006 Keefe et al. ..... 229/179
2006/0138205 A1 * 6/2006 Keefe et al. ..... 229/179
2006/0138206 A1 * 6/2006 Keefe et al. ..... 229/179
2007/0000986 A1 * 1/2007 McClure ..... 229/143

* cited by examiner

*Primary Examiner*—David T Fidei

(57) ABSTRACT

The embodiments of the present invention provide a blank foldable material that may be configured to form a container. When formed, the container is self-locking and includes a rollover panel assemblies formed by spaced apart fold lines that forms bearing surfaces for vertically stacked containers. The container includes a inside taper that functions to prevent telescoping of vertically stacked container, and to hold the various corner panels in their proper location. The blank is configured to form a container that includes corners having multiple thicknesses for strength and stability. The container is self locking, easy us manufacture yet high strength.

5 Claims, 8 Drawing Sheets

INSIDE-TAPER CORNER POST TRAY AND THE ASSOCIATED CONTAINER BLANK

FIELD OF THE INVENTION

This invention relates generally to cellulose-based blanks and containers and more specifically, to wood cellulose-based blanks and containers used for storing and displaying goods.

BRIEF DESCRIPTION OF THE DRAWINGS

Various embodiments of the present invention are described in detail below with reference to the following drawings.

DETAILED DESCRIPTION

The present invention provides a blank and resulting container for holding any variety of goods. By way of overview and with references to FIGS. 1 through 9. An embodiment of the present invention includes a single piece blank 20 of foldable material arranged to form a container 50. Specific details of the blank 20 in container 50 are described with more particularity below.

Figure 1:
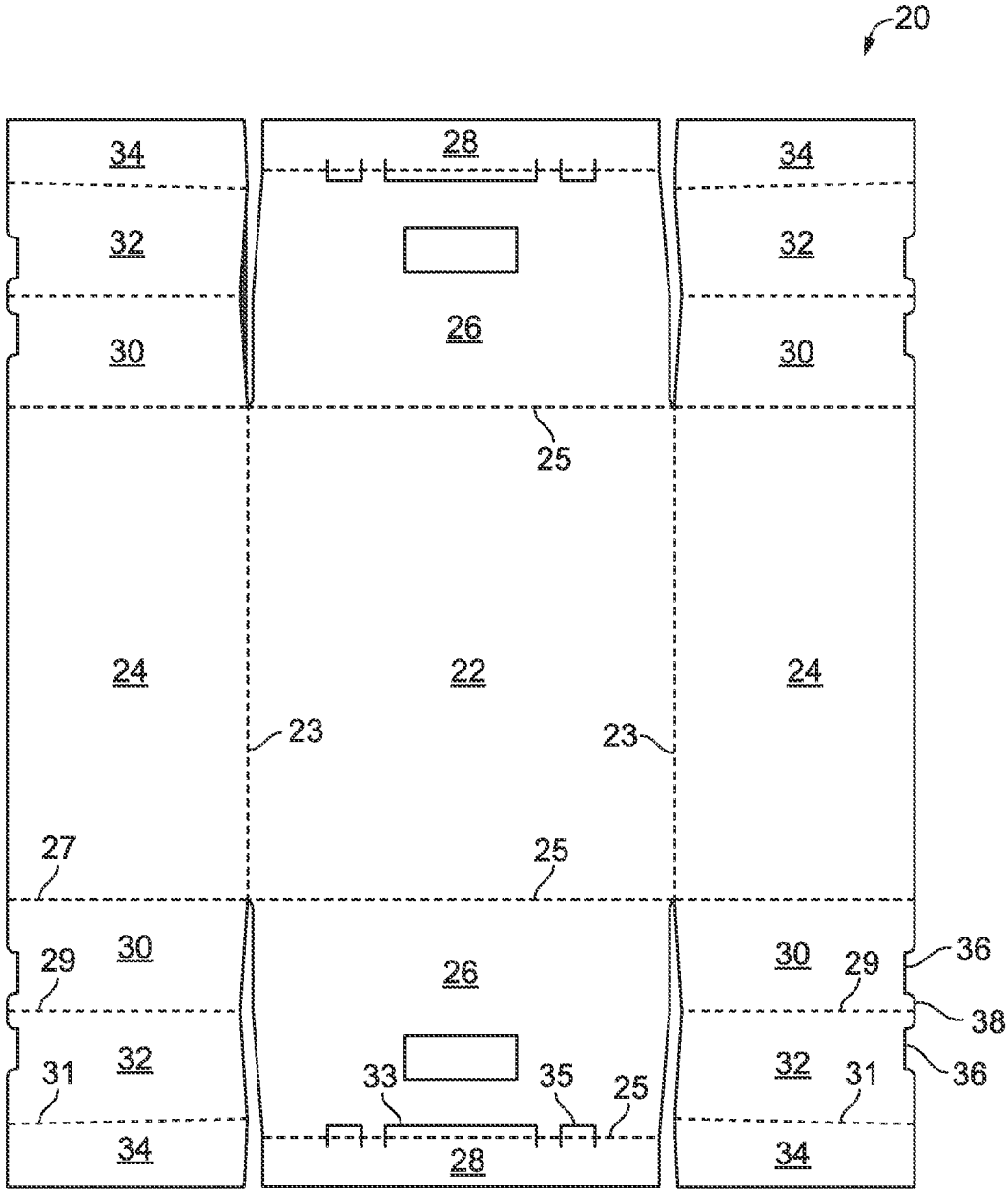
FIG. 1 is a plan view of a single piece of container blank formed in accordance with an aspect of the present invention.

FIG. 1 depicts a blank 20 used to form the container 50. The blank 20 is preferably constructed from a single piece of formable material such as, without limitation, sheets of cellulose-based materials formed from cellulose materials such as wood pulp, straw, cotton, bagasse or the like. Cellulose-based materials used in this present invention come in many forms such as fiberboard, containerboard, corrugated containerboard and paperboard. The blank 20 is cut and scored, perforated or otherwise formed to include a plurality of panels that when assembled form container 50. In all FIGURES, like numbers indicate like parts. Additionally, cut lines are shown as solid lines, score lines as dashed lines, and lines of perforation as broken lines.

With respect to FIG. 1, the blank includes a bottom panel 22, opposed side panels 24 and opposed end panels 26. The bottom panel 22 is generally rectangular in shape and is connected with the side panels along a fold line 23. The bottom panel is connected with end panels 26 along a fold line 25. As depicted in the FIGURE, fold line 23 is substantially perpendicular to fold line 25. The intersection of the respective fold lines 23 and 25 substantially define the corner of the bottom panel 22.

Side panel 24 is generally rectangular in shape. The length of the side panel 24 measured along fold line 23 is substantially equal to the length of the bottom panel 22 measured along the same fold line.

End panel 26 is also generally rectangular in shape and is connected with the bottom panel along fold line 25. End panel 26 may include optional cut-out 44. Said cut-out 44 may be a hand-hold vent or other type structure. The length of the end panel 26 measured along fold line 25 is substantially equal to the width of the bottom panel 22 measured along the same fold line.

Rollover panel 28 is connected with the end panel 26 via spaced apart fold lines 33. H-cuts are formed in a portion of the end panel 26 and a portion of rollover panel 28, and lie substantially perpendicular to the spaced apart fold lines 33.

Attached to the side panel 24 is a first corner assembly panel 30. The first corner assembly panel 30 is connected to the side panel 24 along a fold line 27. Connected to the first corner assembly panel 30 opposite said side panel 24 is a second corner assembly panel 32. The second corner assembly panel 32 is attached with the first corner assembly panel 30 along a fold line 29. The third corner assembly panel 34 is attached to the second corner assembly panel 32 along a fold line 31. As formed the first corner assembly panel 30, second corner assembly panel 32, and third corner assembly panel 34 lie adjacent to, but are not connected with end panel 26.

It is to be understood that the various panels are to be cut such that when the container is erected as disclosed below, the open top are of the container is smaller than the bottom panel. This is achieved by forming the various side, end and corner assembly panels with an inside taper to them. The inside taper design causes the various sidewalls to lean slightly inwardly when the container is erected. Two distinct advantage result from the inside taper. First, since the top is smaller4 than the bottom, it helps to discourage telescoping when multiple containers are stacked vertically. Secondly, the inside taper helps keep the various corner panels locked into position. Both of these advantages are not typically found in straight walled containers.

In order to further illustrate the various aspects about the embodiments, FIGS. 2 through 9, depict the blank 20 being erected into container 50. Typically, this is a hand-set container 50. However, it will be understood that mechanical box erecting equipment may be used in the erection of the container 50. As mechanical box erecting equipment is well know in the art a detailed description of such equipment is not necessary to understand the spirit and scope of the embodiments contained herein.

Figure 2:
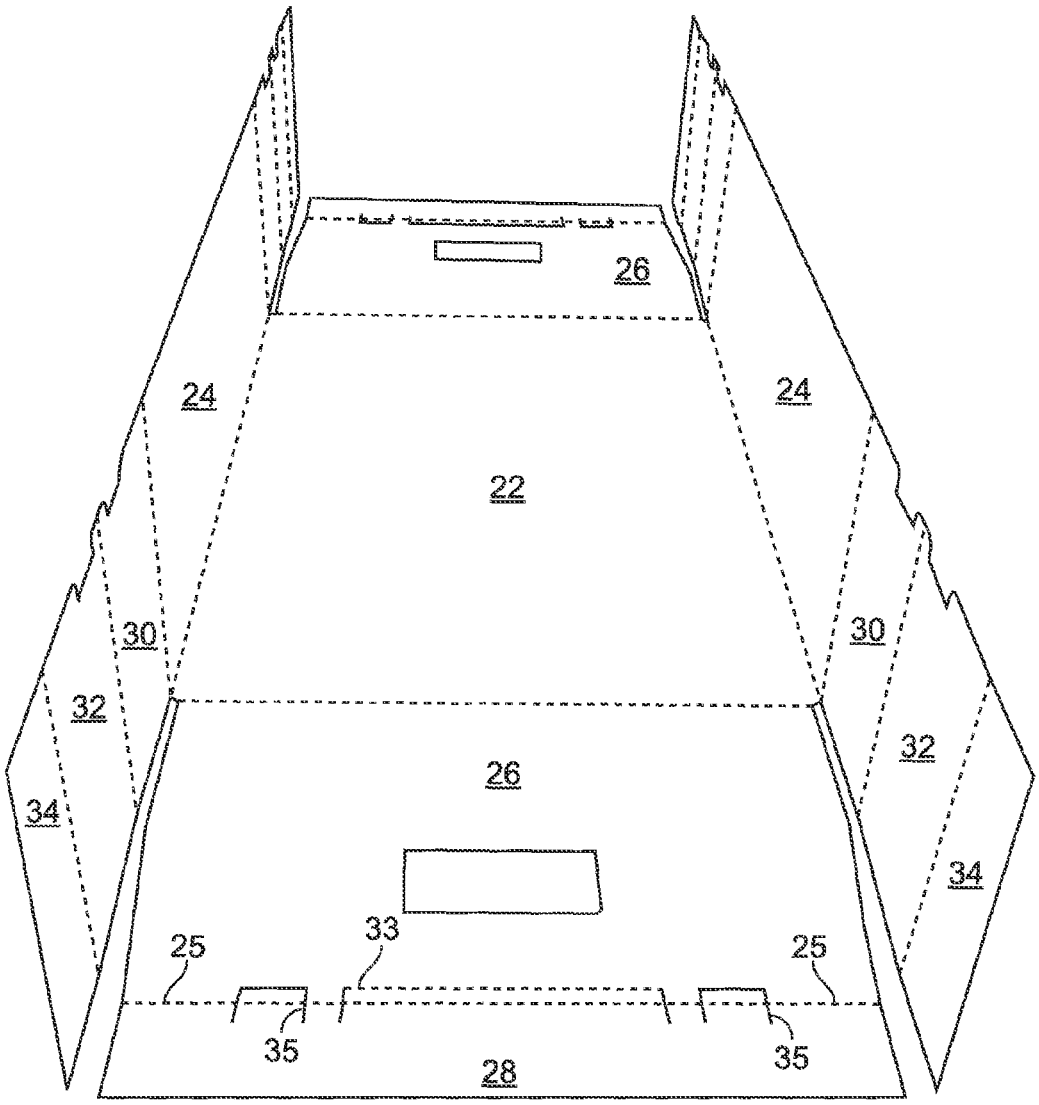
FIG. 2 is a perspective view of a partially assembled container assembly according to an aspect of the present invention.
Figure 3:
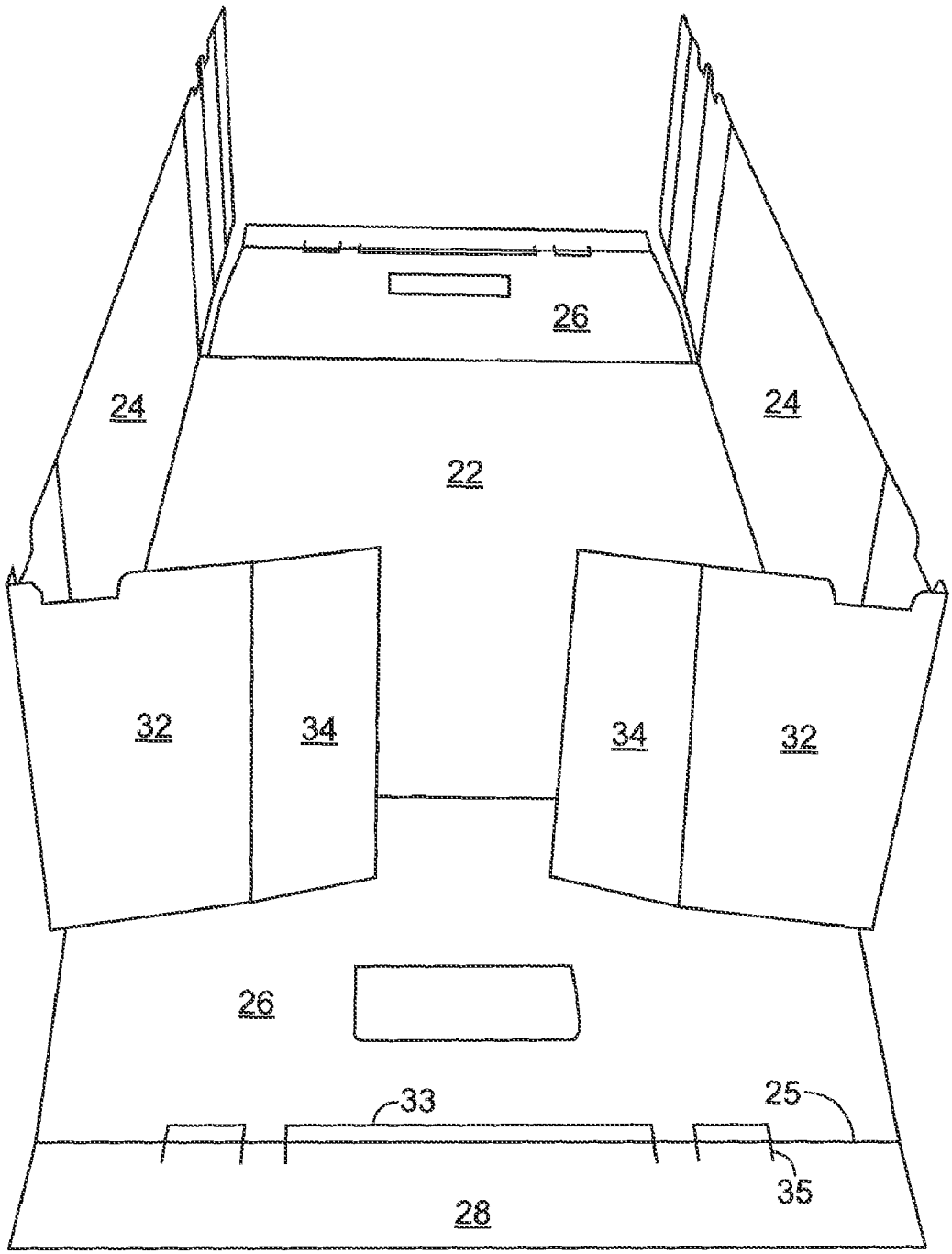
FIG. 3 is another perspective view of a partially assembled container assembly according to yet an another aspect of the present invention.
Figure 4:
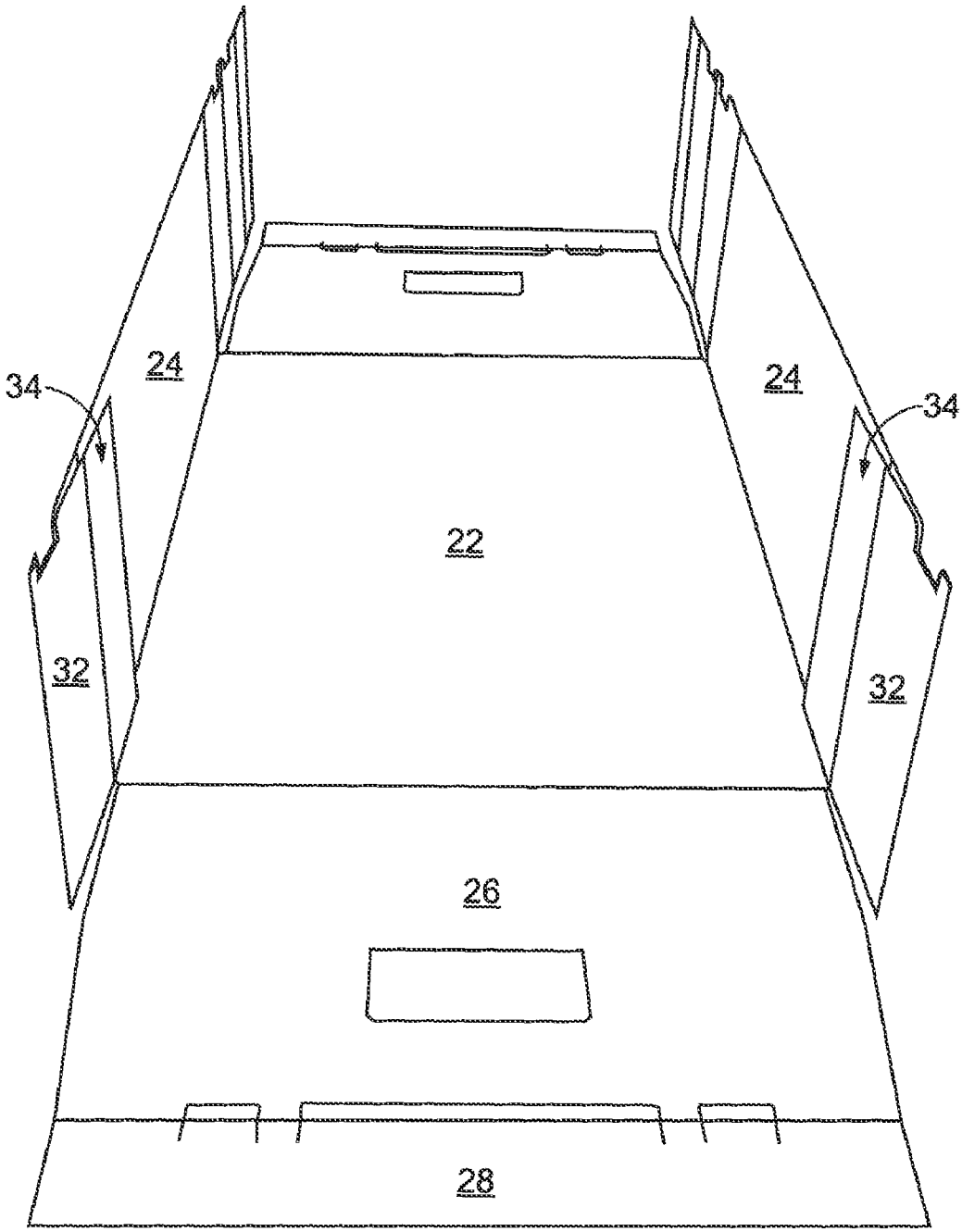
FIG. 4 is still further another perspective view of a partially assembled container assembly according to an aspect of the present invention.
Figure 5:
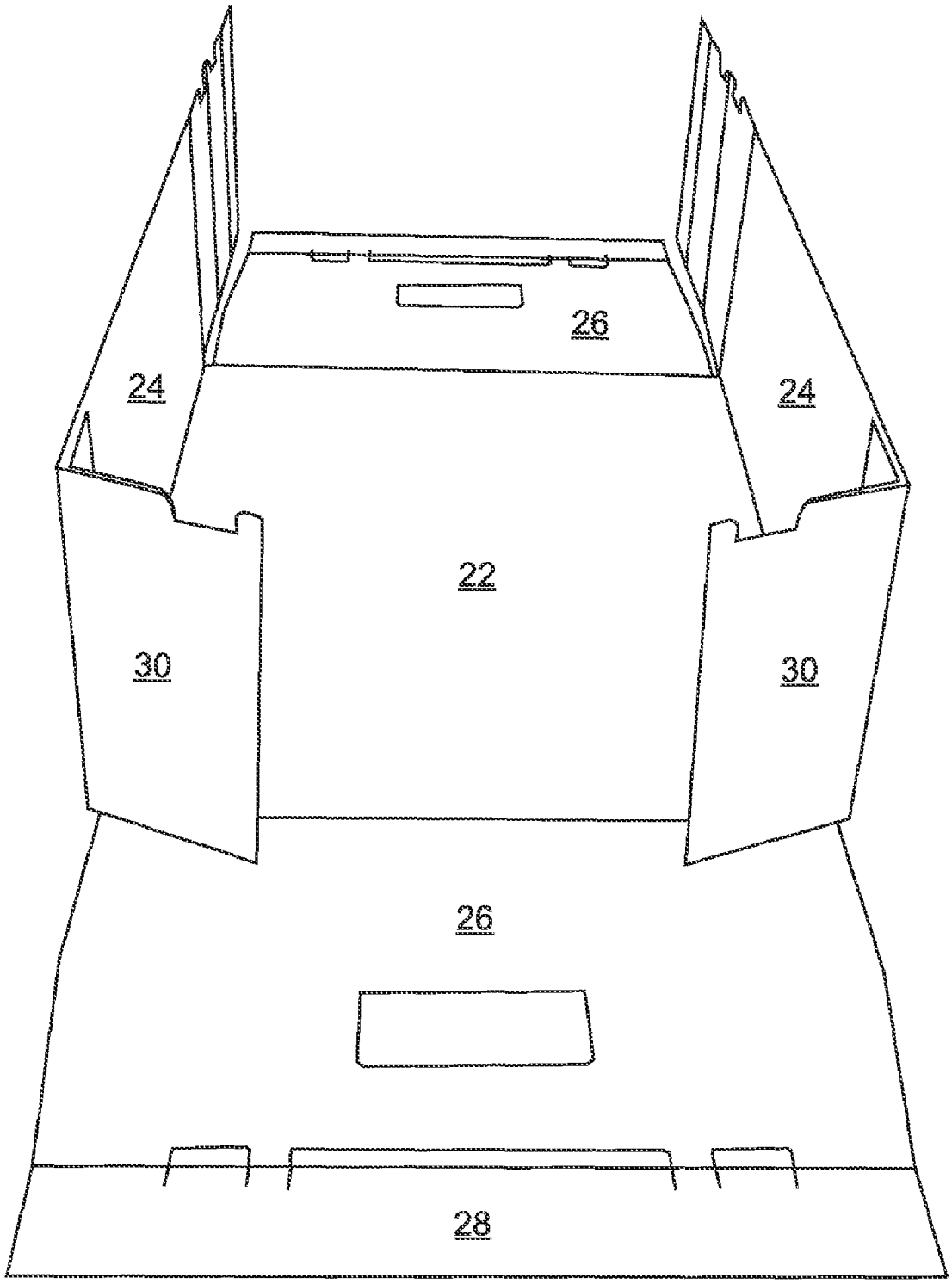
FIG. 5 is still further another perspective view of a partially assembled container assembly according to an aspect of the present invention.
Figure 6:
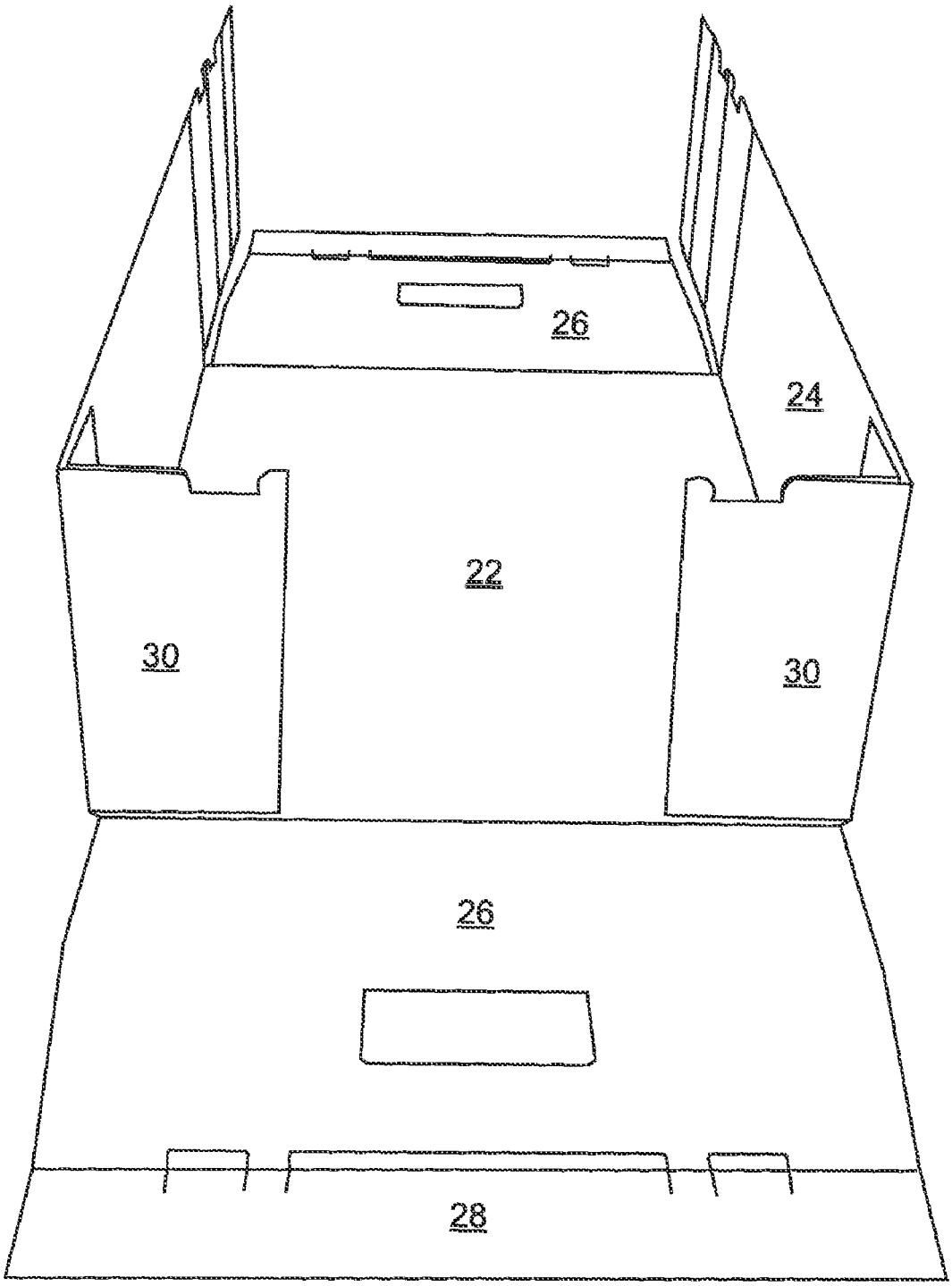
FIG. 6 is still further another perspective view of a partially assembled container assembly according to an aspect of the present invention.

With specific reference to FIGS. 2 and 3, side panels 24 are generally folded upward along fold line 23 approximately 90 degrees. The folding of the side panel 24 in this manner, also results in the disposition of the first corner assembly panel 30, second corner assembly panel 32, and third corner assembly panel 34 in a similar fashion. Subsequently, the second corner assembly panel 32 and third corner assembly panel 34 are folded inwardly about 180 degrees around fold line 29 such that the second corner assembly panel 32 and third corner assembly panel 34 lie juxtaposed the first corner assembly panel 30 and a portion of the side panel 24. This folding procedure will bring the saddle cutouts 36 formed in both the first corner assembly panel 30 and the second corner assembly panel 32 into alignment.

It should also be noted, as depicted in the FIGURES, the overall size of the second corner assembly panel 32 and third corner assembly panel 34 are such that the width of the bottom panel 22 measured along fold line 25 is greater than twice the combined length of the second corner assembly panel 32 and third corner assembly panel 34 measured along the same fold line 25. However, it will be appreciated by those skilled in the art, that the width of the bottom panel 22 measured along fold line 25 may be equal to about twice the combined length of the second corner assembly panel 32 and third corner assembly panel 34 measured along the same fold line 25.

The next box erection step is to fold the first corner assembly panel 30 and the second corner assembly panel 32 inwardly about 90 degrees along fold line 27. This step places the first corner assembly panel 30 and the second corner assembly panel 32 in a plane that is substantially perpendicular to the plane the third corner assembly panel 34 and the side panel 24 share. It will be appreciated that in this stage of container erection, the saddle cutouts 36 are substantially aligned with the H-cut 35, this relationship will be described in more detail below.

Figure 7:
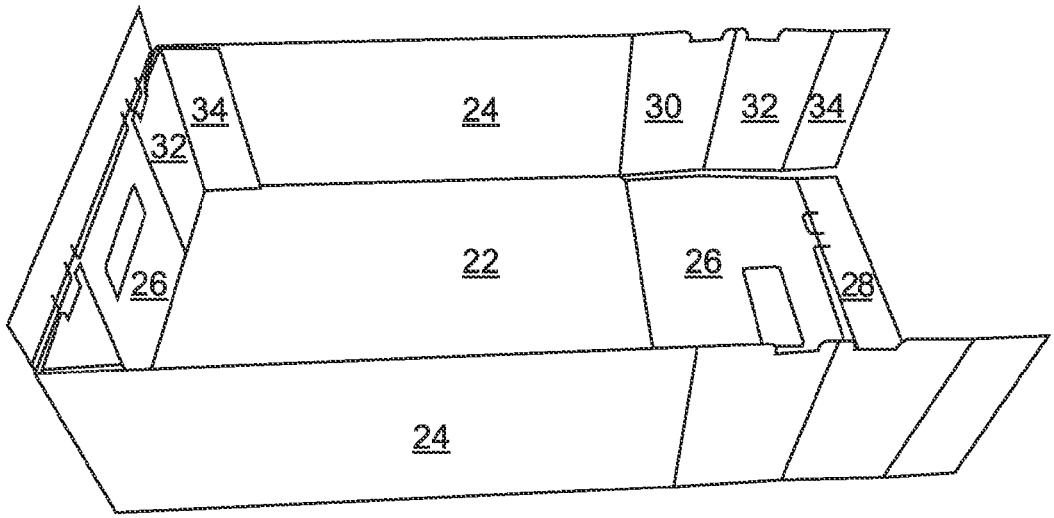
FIG. 7 is still further another perspective view of a partially assembled container assembly according to an aspect of the present invention.

Subsequently end panels 26 and rollover panels 28 are folded inwardly along a fold line 23. As best seen in FIG. 7, this relationship substantially forms the general container shape.

Figure 8:
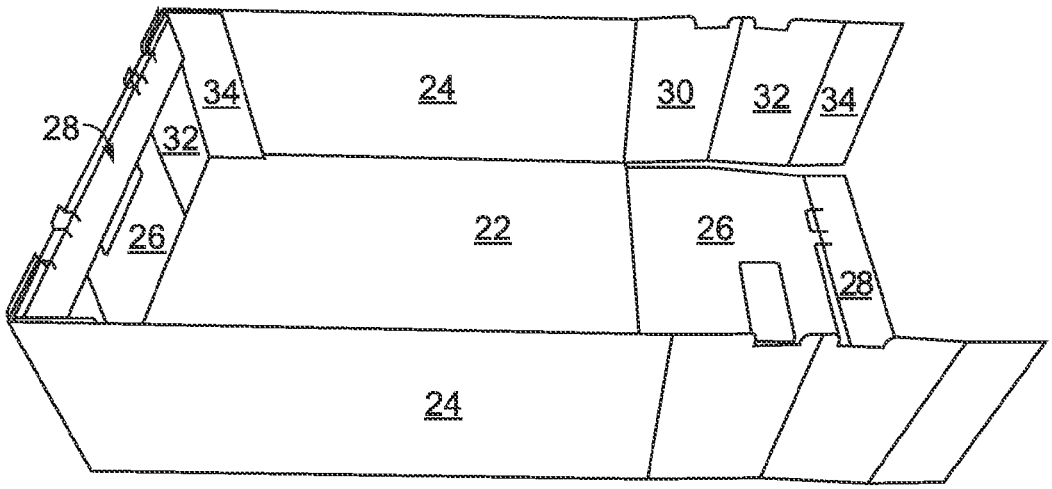
FIG. 8 is still further another perspective view of a partially assembled container assembly according to an aspect of the present invention; and, FIG. 9 is a perspective view of the assembled container according to an aspect of the present invention.
Figure 9:
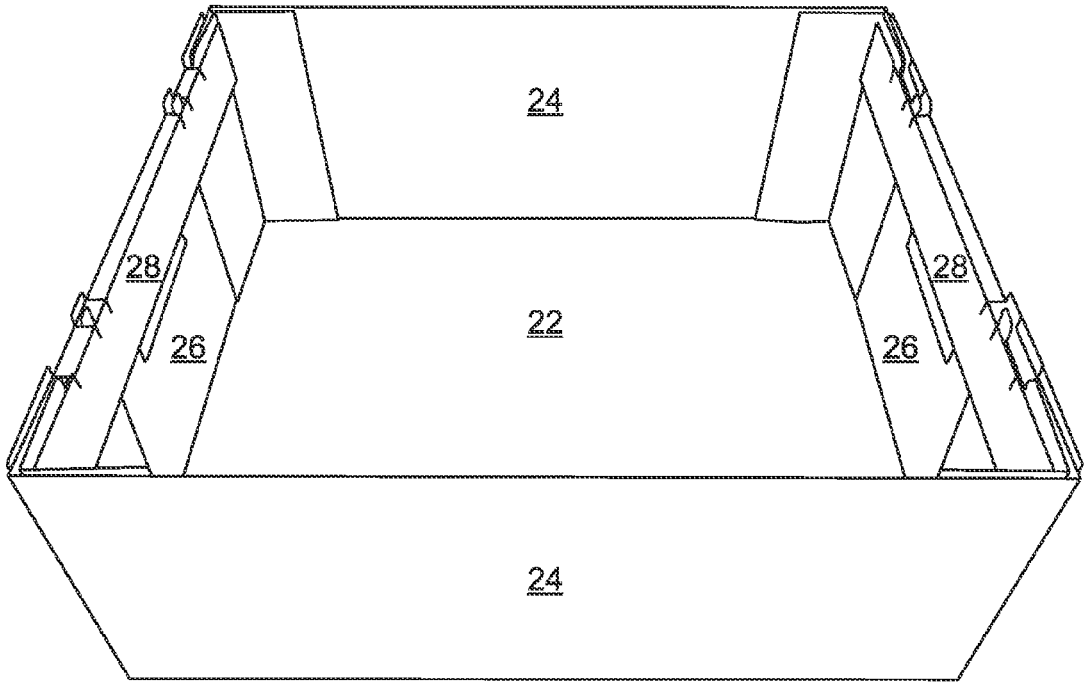

With specific references now to FIGS. 7-9, the locking of the various panels to form the container 50 is illustrated. Specifically, once the various corner assembly panels are folded to their formed position, the rollover panels 28 can be folded downwardly approximately 90 degrees along spaced apart fold line 33 to bring the rollover panel 28, into a juxtaposed position with second corner assembly panel 32. This erection step also includes the engagement of tab 38 through the H-cutout such that straps 37 are positioned within the saddle cutouts 36.

These assorted corner panel assemblies are configured to form multi-panel corner assemblies once the container 50 is formed. As these panels will, to an extent, fold over each, their juxtaposed positioned relative to each other combined with their association with the side panel 24 provide a container with significantly increased corner stacking strength. Further, as the various corner assembly panels are connected, and as they extend along both the side panel 24 and end panel 26, the lateral strength of the container 50 is greatly increased. Also the spaced apart fold lines 33 that define the rollover panel 28 provides a stacking or bearing surface for successive containers 50 to be stacked vertically on top of one another (not shown).

One of the many unique features of this embodiment is the extremely limited use of adhesive or the lack of needing to use adhesive at all. In one embodiment, no adhesive or fasters are used with this container 50. In another embodiment adhesive is used only between side panel 24 and the first corner assembly panel 30. The specific location where an adhesive is placed between the respective panels will be known to those skilled in the art and is therefore not discussed herein. However, it will be appreciated that the location and amount of adhesive, if used, will be sufficient to ensure container integrity.

The container 50 as shown is simple to manufacture, easy to assemble and may be a design of considerable usage in club stores or bulk stores where products are sold in large quantities on the open floor. However, this design is also useful in any variety of retail or wholesale environments.

While various embodiments of this invention have been illustrated and described, as noted above, many changes can be made without departing from the spirit and scope of this invention. Accordingly, the scope of the invention is not limited by the disclosure of the various embodiments. Instead, the invention should be determined entirely by references to the claims that follow.

What is claimed is:

1. A single sheet of foldable material cut and scored to define a container, comprising:

a bottom panel;

an end panel connected with the bottom panel wherein the end panel includes an outside edge extending from the bottom panel, said outside edge having a tapered first part and second part that causes the end panel to lean inwardly when the container being constructed;

a side panel connected with the bottom panel, the side panel having a first, second, and third corner assembly panels without being connected to the bottom panel and end panel wherein the first, second, and third corner assembly panels are tapered with respect to the bottom panel and end panel in a manner that causes the first, second, and third corner assembly panels being configured in locking position and leaning inwardly when folded and prevent unfolding of the first, second, and third corner assembly panels when the container being constructed; and a rollover panel juxtaposed said second corner assembly panel when in a folding position, said rollover panel being connected with said end panel via a pair of straps extending between the rollover panel and the end panel.

2. The container of claim 1, wherein the single sheet of foldable material is formed from a cellulose-based material.

3. The container of claim 2, wherein the cellulose based material is formed from at least one of a wood pulp, straw, cotton, and bagasse.

4. The container of claim 2, wherein the cellulose based material is in the form of at least one of a fiberboard, containerboard, corrugated containerboard and paperboard.

5. The container of claim 1, wherein the tapered first part and second part prevent telescoping when multiple of containers are stacked on one another.

* * * * *